US008256506B2

(12) United States Patent
Dyson et al.

(10) Patent No.: US 8,256,506 B2
(45) Date of Patent: Sep. 4, 2012

(54) TUBING HANGER

(75) Inventors: Andy Dyson, Stonehaven (GB); Charles Li, Spring, TX (US); Oystein Mogedal, Oslo (NO); Paulo Cezar Silva Paulo, Katy, TX (US); Nick Newlands, Oslo (NO)

(73) Assignee: Aker Subsea Inc., Houston, TX (US)

( * ) Notice: Subject to any disclaimer, the term of this patent is extended or adjusted under 35 U.S.C. 154(b) by 431 days.

(21) Appl. No.: 12/543,929

(22) Filed: Aug. 19, 2009

(65) Prior Publication Data

US 2010/0089590 A1 Apr. 15, 2010

Related U.S. Application Data

(60) Provisional application No. 61/090,462, filed on Aug. 20, 2008, provisional application No. 61/090,000, filed on Aug. 19, 2008.

(51) Int. Cl.
*E21B 23/00* (2006.01)
*E21B 43/10* (2006.01)

(52) U.S. Cl. ..... 166/85.1; 166/382

(58) Field of Classification Search ..... 166/85.5, 166/360, 85.1; 285/123.2, 123.4
See application file for complete search history.

(56) References Cited

U.S. PATENT DOCUMENTS 4,595,063 A * 6/1986 Jennings et al. ..... 166/382
4,757,860 A 7/1988 Reimert
4,836,579 A * 6/1989 Wester et al. ..... 285/3
5,307,879 A 5/1994 Kent
5,769,162 A 6/1998 Bartlett et al.
6,378,613 B1 4/2002 Kent et al.
6,488,083 B2 12/2002 Bartlett et al.
6,516,875 B2 2/2003 Reilly et al.
6,679,330 B1 1/2004 Compton et al.
6,691,285 B1 2/2004 Burden et al.
6,691,785 B2 2/2004 Patel
6,840,323 B2 1/2005 Fenton et al.
6,978,839 B2 12/2005 Fenton et al.
7,025,133 B2 4/2006 McIntosh
7,219,741 B2 5/2007 Fenton et al.

OTHER PUBLICATIONS

International Search Report and Written Opinion issued in PCT/US2009/054331.

* cited by examiner

*Primary Examiner* — Kenneth L Thompson
(74) *Attorney, Agent, or Firm* — Parsons Behle & Latimer

(57) ABSTRACT

A tubing hanger for use in a wellhead. The wellhead includes a throughbore, a landing seat positioned in the throughbore, a landing groove positioned above the landing seat in the throughbore, and a locking groove in the throughbore. The tubing hanger comprises an expandable landing ring positioned on the tubing hanger for engaging the landing groove and a landing mechanism for expanding the landing ring radially outward from the tubing hanger. A locking ring for engaging the locking groove can be positioned on the tubing hanger. The tubing hanger can further include a locking mechanism for expanding the locking ring radially outward from the tubing hanger body and locking it into the locking groove.

15 Claims, 5 Drawing Sheets

TUBING HANGER

The present disclosure claims benefit of U.S. Provisional Patent Application No. 61/090,462, filed Aug. 20, 2008, and U.S. Provisional Patent Application No. 61/090,000, filed Aug. 19, 2008, both of which applications are hereby incorporated by reference in their entirety.

BACKGROUND

The present disclosure relates generally to a tubing hanger for use with a subsea wellhead, and in particular, a mechanism for positioning and locking a tubing hanger into a subsea wellhead.

Tubing hangers are employed in subsea wellheads used in, for example, oil and gas wells. The tubing hanger supports the tubing, or "string", which extends down into the production zone of the well. The process of installing a tubing hanger into a wellhead generally involves positioning the tubing hanger on a landing seat in the wellhead using, for example, a running tool attached to the tubing hanger.

Movement of the tubing hanger inside the wellhead after installation is a known problem. Tubing hanger movement can be caused by, for example, torsional force applied to the tubing hanger due to thermal expansion and contraction of the tubing string. Excessive movement can change the orientation of the tubing hanger with respect to the wellhead, making it difficult to reinstall the running tool during subsequent operations or to subsequently install the subsea tree on the wellhead. Movement of the tubing hanger can also cause premature failure of the sealing system between the tubing hanger body and the wellhead housing, and the seals at the hydraulic and electric connectors between the tubing hanger and the subsea Christmas tree.

Various mechanisms for securing tubing hangers in wellheads have been devised in order to reduce movement of the tubing hanger in the wellhead. For example, locking mechanisms are often employed to lock the tubing hanger into place in the wellhead. In addition, means for preloading the tubing hanger in order to reduce undesirable axial and rotational movement of the tubing hanger have also been devised.

However, providing the desired preloading of the locked tubing hanger can be difficult to achieve when the landing seat of the tubing hanger inside the wellhead has uncertain axial position. The uncertainty of the axial position can be due, at least in part, to tolerance accumulations caused by the stacking of many components in the wellhead and debris that can accumulate on the landing seat during drilling operations.

To account for this uncertainty in axial seating position, tubing hanger designs have employed adaptive mechanisms in order to accommodate large dimensional variations and still achieve preloading. One typical form of this type of mechanism employs a locking ring with tapered inner surface, being pushed into the receptive profiles by applying a measured force to wedge a locking sleeve behind the locking ring. Because this type of locking ring relies on the friction between the tapered surfaces of the locking ring and the locking sleeve to maintain the locking ring in a preloaded locking state, it is necessary to employ additional locking (or anti-backoff) to prevent the loss of preload from the movements of the locking sleeve under vibration and other disturbance over long term field service. Moreover, the final axial position of the locking sleeve has large variation because the small taper angle used for maintaining the frictional self lock amplifies the manufacturing tolerance in diametric dimensions of the relevant components. Thus implementation of anti-backoff of the locking sleeve is often adaptive in nature and sometimes depending on friction itself. One example of a design that employs a lockdown mechanism with an actuating mandrel that includes an anti-backoff mechanism is disclosed in U.S. Pat. No. 6,516,875.

One design for a tubing hanger with a preloaded lockdown mechanism is disclosed in U.S. Pat. No. 5,145,006, issued to David R. June. In the June patent design, the tubing hanger is locked into place and then a torque ring is rotated to preload the locking mechanism. However, this design requires a tool, such as a mechanical torque tool, that can be run to the subsea wellhead to rotate the torque ring to its preloaded position. Further, the torque applied to provide the desired preload using the June patent design can be problematic. In deep water well completions, for example, applying torque at the top side over a long running string can be undesirable.

Other tubing hanger designs achieve preloaded locking with non-adaptive components, such as a locking ring with a non-tapered, cylindrical inner surface. Once the locking sleeve is forced into an axial position behind the locking ring, the preload is entirely determined by the deflections of the components within the load path that have controlled dimensional interferences and that are insensitive to the axial position of the locking sleeve. In one previous design, where a tubing hanger with such a locking mechanism was landed onto a shoulder with large axial position variation, a pre-installation measurement trip had to be made for each installation to determine the position of each landing shoulder so that the tubing hanger could be adjusted before installation to obtain the required dimensional interference. Such measurement trips not only add operational cost, which is significant in deep water application, but also introduce additional uncertainty.

Improved designs for locking a tubing hanger into a wellhead with preload would be a welcome addition in the art. The present disclosure is directed to overcoming, or at least reducing the effects of, one or more of the issues set forth above.

SUMMARY

An embodiment of the present disclosure is directed to a tubing hanger for use in a wellhead. The wellhead includes a throughbore, a landing seat positioned in the throughbore, a landing groove positioned above the landing seat in the throughbore, and a locking groove in the throughbore. The tubing hanger comprises an expandable landing ring positioned on the tubing hanger for engaging the landing groove and a landing mechanism for expanding the landing ring radially outward from the tubing hanger. A locking ring for engaging the locking groove can be positioned on the tubing hanger. The tubing hanger can further include a locking mechanism for expanding the locking ring radially outward from the tubing hanger body and locking it into the locking groove.

Another embodiment of the present disclosure is directed to a method for locking a tubing hanger in a wellhead. The wellhead includes a throughbore, a landing seat positioned in the throughbore, a landing groove positioned above the landing seat in the throughbore, and a locking groove positioned in the throughbore. The method comprises expanding a landing ring positioned on the tubing hanger to engage the landing groove. A locking ring can be expanded to engage the locking groove, the locking ring being positioned on the tubing hanger. The locking ring is expanded after the expanding of the landing ring.

Figure 1:
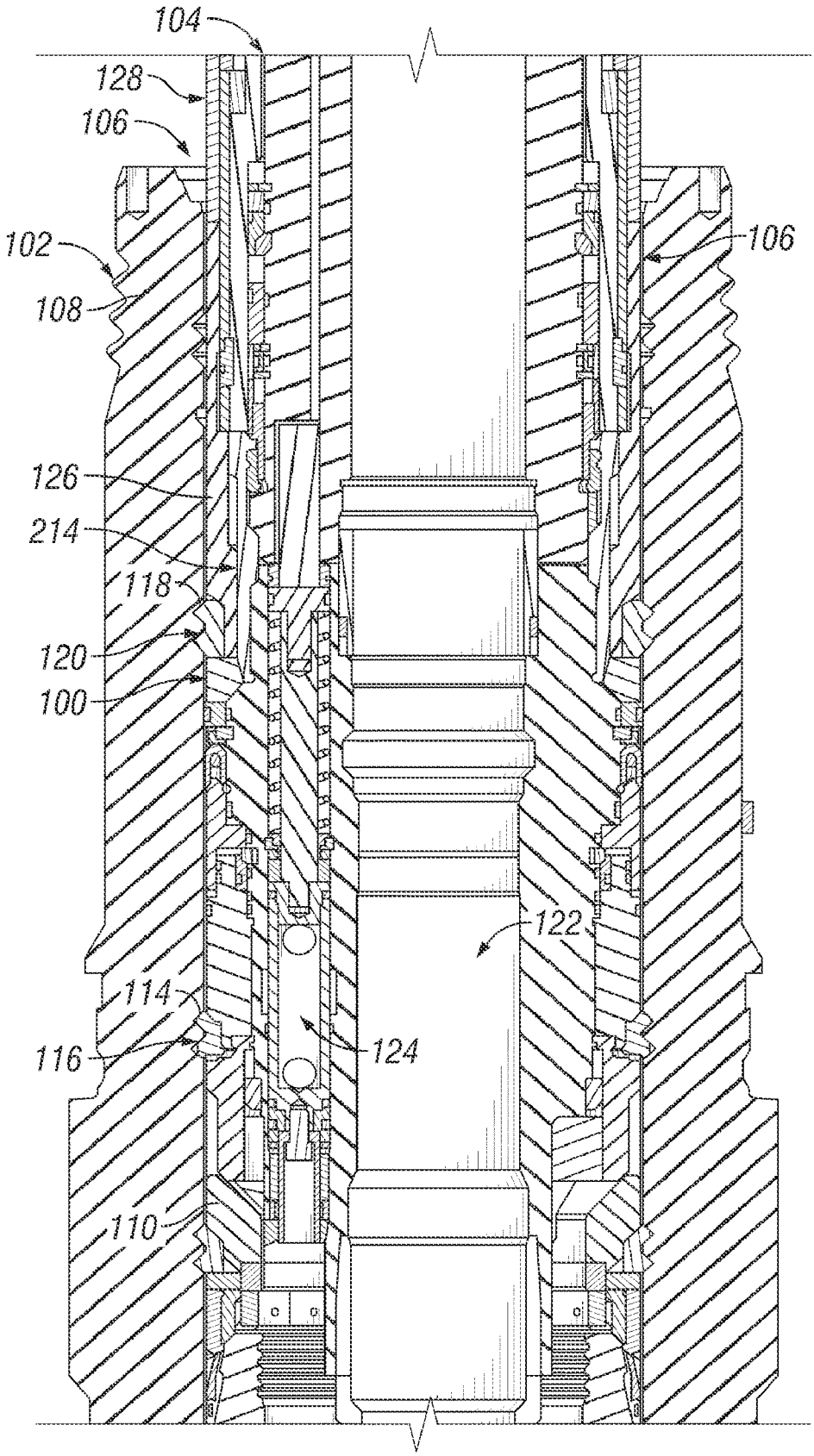
FIG. 1 illustrates the presented tubing hanger in locked state and supported by the integral expandable landing ring, according to an embodiment of the present disclosure.

While the concepts of the present disclosure are susceptible to various modifications and alternative forms, specific embodiments have been shown by way of example in the drawings and will be described in detail herein. However, it should be understood that the present disclosure is not intended to be limited to the particular forms disclosed. Rather, the intention is to cover all modifications, equivalents and alternatives falling within the spirit and scope of the invention as defined by the appended claims.

DETAILED DESCRIPTION

FIG. 1 illustrates a subsea tubing hanger 100 positioned in a wellhead 102. A tubing hanger running tool 104 engaging the tubing hanger 100 is also shown. As is well known in the art, the tubing hanger running tool 104 can be used to lower the tubing hanger 100 into position in the wellhead 102.

The wellhead 102 includes a throughbore 106 defined by a wellhead housing wall 108. A landing seat 110 is positioned in throughbore 106 and can be any top profile of installed equipment below the tubing hanger, usually with large axial positional variation. In an embodiment, the landing seat 110 can be a casing hanger packoff, which may act to seal the wellhead housing wall 108 and the casing hanger. In other embodiments, the landing seat may be another piece of equipment that does not act as a seal, such as other equipment installed before the tubing hanger 100.

A landing groove 114 can be positioned above the landing seat 110 in the throughbore 106 for receiving a landing ring 116. A locking groove 118 can be positioned above the landing groove 114 in the throughbore 106. Landing groove 114 and locking groove 118 can be formed in throughbore 106 by any suitable method, such as by machining the grooves in the surface of wellhead housing wall 108 that forms the outer perimeter of throughbore 106.

Tubing hanger 100 can include a tubing hanger body 214. Tubing hanger body 214 can include one or more fluid passages therein (not shown), as is well known in the art. In an embodiment, tubing hanger 100 can also include one or more annulus fluid passages 124 positioned around the tubing hanger production bore 122.

As discussed above, an expandable landing ring 116 is positioned on the tubing hanger 100 for engaging the landing groove 114. As more clearly illustrated in FIGS. 2 and 3, expandable landing ring 116 can be configured to work in conjunction with a landing mechanism 200 for expanding the landing ring 116 radially outward from the tubing hanger body 214.

Figure 2:
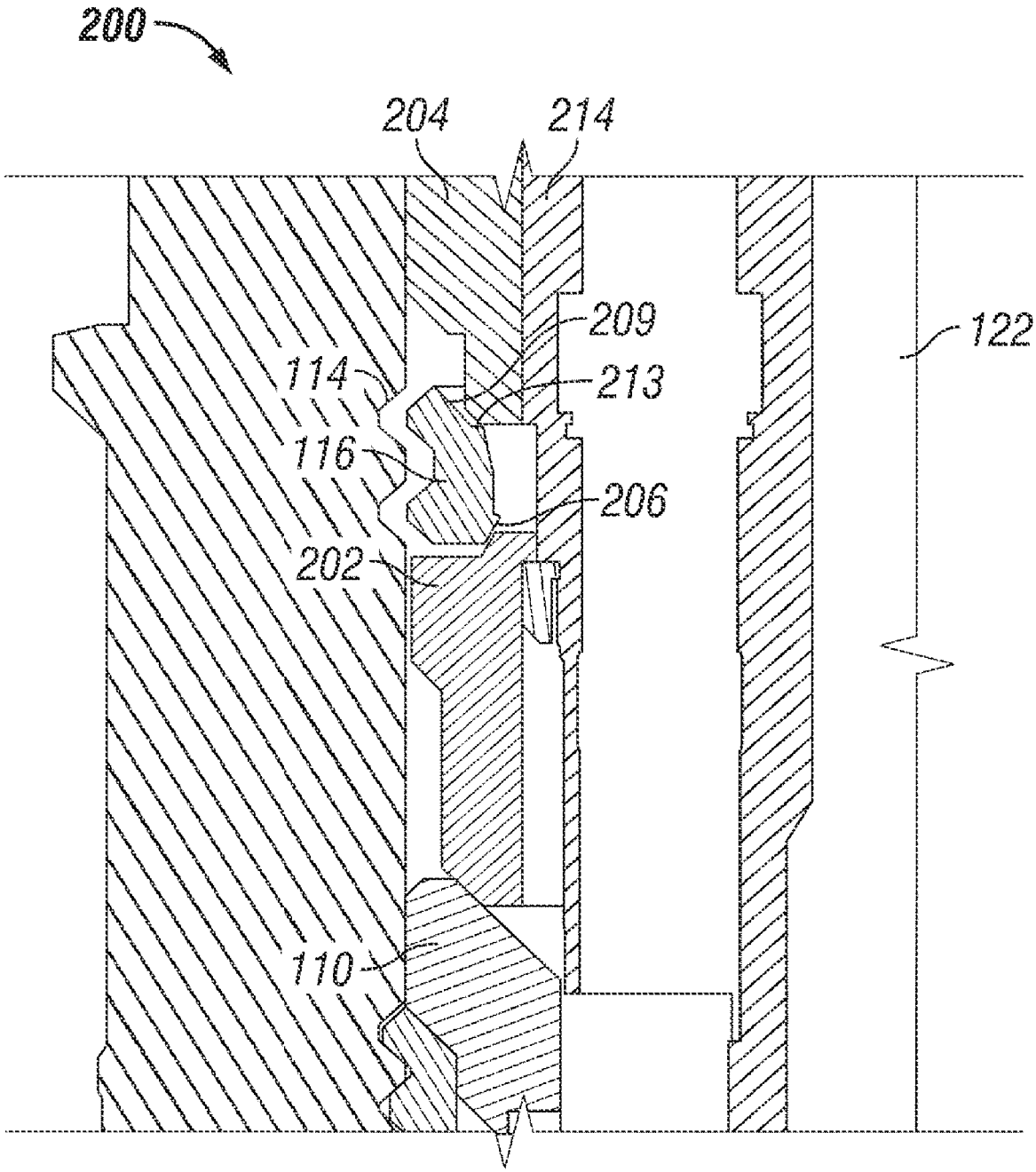
FIGS. 2 to 5 illustrate the operation of a landing mechanism as the tubing hanger is landed in the well, according to an embodiment of the present disclosure.

The landing mechanism 200 can be positioned to engage the landing seat 110 during installation of the tubing hanger 100 into the wellhead. As illustrated in FIG. 2, the expandable landing ring 116 can be retracted inside of the hanger profile during the installation run. The landing mechanism 200 can be configured so that a downward force of the landing mechanism 200 on the landing seat 110 during the installation is capable of expanding the landing ring 116 into the landing groove 114.

The embodiment of the landing mechanism illustrated in FIGS. 2 to 5 is similar to that of FIG. 1, except that landing ring 116, landing ring actuator 202 and lower load ring 204 have slightly simplified designs. However, the landing mechanisms illustrated in both FIG. 1 and FIGS. 2 to 5 function in a similar manner and the discussion of FIGS. 2 to 5 applies to the design of FIG. 1.

Figure 3:
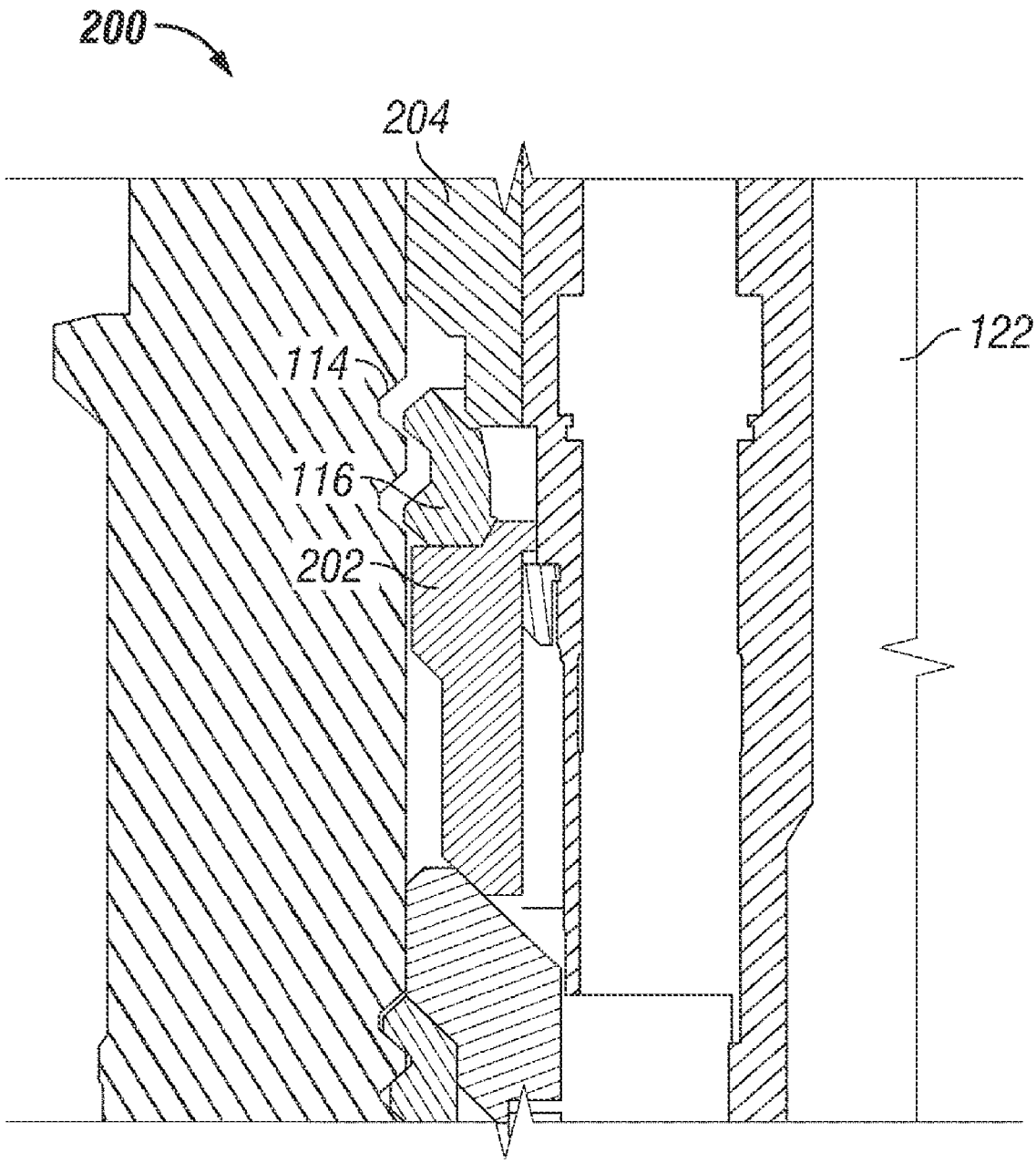
Figure 4:
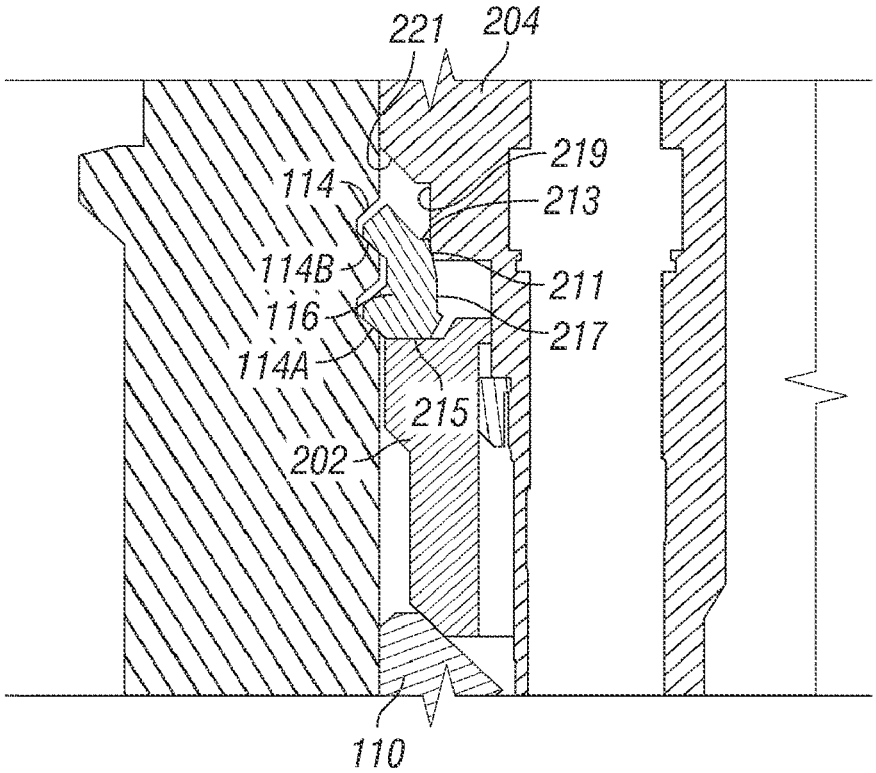
Figure 6:
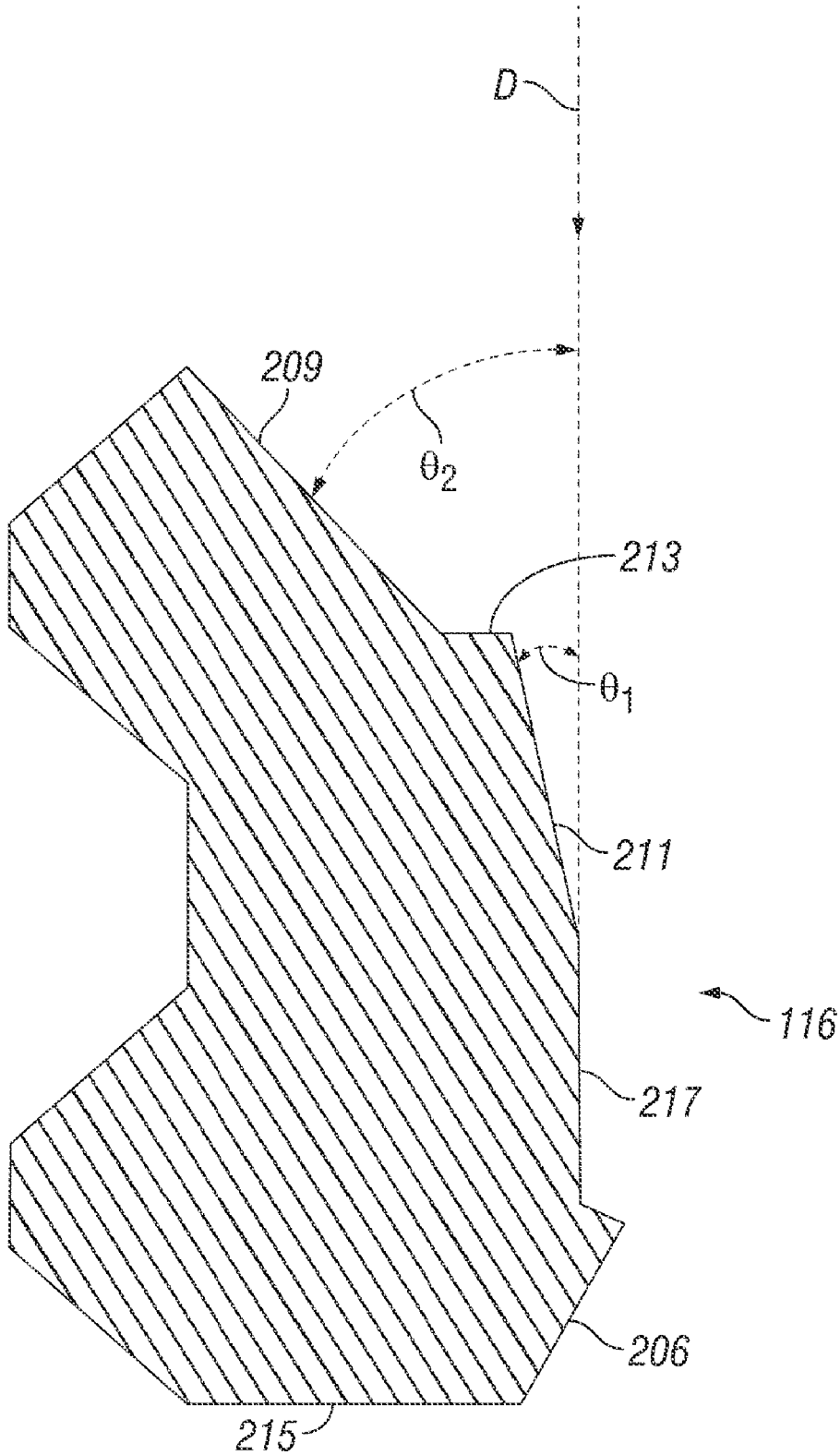
FIG. 6 illustrates a cross-sectional view of a landing ring, according to an embodiment of the present disclosure.

In an embodiment according to FIG. 2, the landing mechanism 200 can include a landing ring actuator 202 and a lower load ring 204. The landing ring actuator 202 can be positioned below the expandable landing ring 116, so as to make first contact with the landing seat 110 during the tubing hanger installation run. As shown in FIGS. 2 and 3, once the landing ring actuator 202 engages the landing seat 110, the continued downward movement of the tubing hanger will create reaction forces at the tapered surfaces 206,209 of landing ring 116 as it contacts landing ring actuator 202 and lower load ring 204. The resultant forces can expand landing ring 116 radially outward to make initial contact with landing groove 114 (FIG. 4). At this position, landing ring 116 contacts lower load ring 204 at a tapered surface 211 that is angled more steeply relative to the axial downward motion of lower load ring 204 than is the tapered surface 209. This is illustrated in FIG. 6, which shows an arrow "D" that represents the direction of movement of the tubing hanger into the well. As shown in FIG. 6, the angle, $\theta_1$, between the surface 211 and the arrow D, is smaller than the angle, $\theta_2$, between the surface 209 and the arrow D. In an embodiment, the line representing surface 217 in FIG. 6 is substantially parallel to the line of motion represented by arrow D, so that $\theta_1$ and $\theta_2$ also indicate the angle between surface 217 and surfaces 211 and 209, respectively.

The resultant force from landing ring 116 contacting landing groove 114 and lower load ring 204 can enable landing ring 116 to expand along the lower tapered surfaces 114A, 114B of landing groove 114 upward, thereby separating landing ring 116 from landing ring actuator 202. This separation is illustrated by the space 223 shown in FIG. 5. In other embodiments, separation of the landing ring 116 form the landing ring actuator 202 may not occur.

Figure 5:
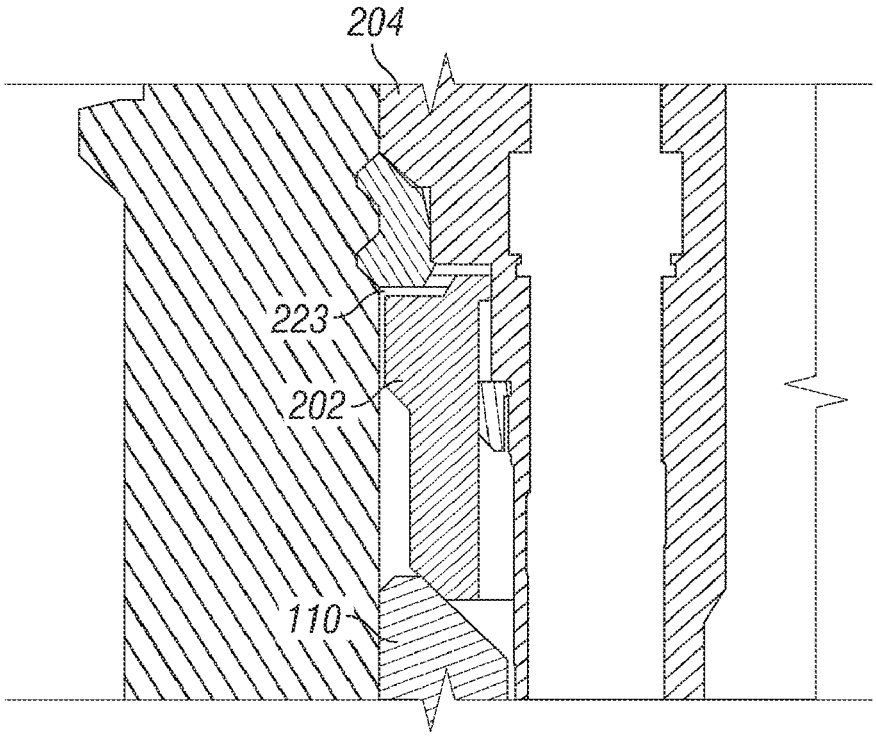

Surface 217 of landing ring 116 and surface 219 of load ring 204 are shaped so that continued travel of the tubing hanger into the well will not significantly change the lateral position of landing ring 116. For example, in the illustrated embodiment, surface 217 and surface 219 are both cylindrically shaped without a taper relative to the axial movement of load ring 204, so that little or no lateral force is applied to landing ring 116 as the load ring 204 continues moving into the well. The tubing hanger can be stopped when the load bearing surface 221 of lower load ring 204 makes contact with landing ring 116, resulting in the tubing hanger being fully supported by landing ring 116, as shown in FIG. 5. Thus the final position of landing ring 116, and hence the position of the tubing hanger, can be entirely defined by landing groove 114 and lower load ring 204, and does not necessarily depend on the precise location of landing seat 110 on which landing ring actuator 202 rests. Therefore the positional variation of landing seat 110 does not affect the position of the tubing hanger.

In FIGS. 2 to 5 the radial expansion of landing ring 116 is energized in three stages. To avoid the premature radial expansion of landing ring 116 before reaching the intended landing position, the top of landing ring 116 initially contacts lower load ring 204 at a small flat face 213 (shown more clearly in FIG. 6) that is substantially perpendicular to the axial movement of lower load ring 204 into the well, so that accidental contact of landing ring 116 against the outside wall during downward trip will not likely produce an expansion force from lower load ring 204 onto landing ring 116 (FIG. 2).

The initial expansion of landing ring 116 can therefore result from landing ring actuator 202 reaching a stop (such as making contact with preinstalled landing seat 110) so that the tapered contact between landing ring 116 and landing ring actuator 202 creates a resultant radial expansion force for landing ring 116. Due to the initial radial expansion, the tapered surface 211 of landing ring 116 contacts lower load ring 204 and a surface 215 of landing ring 116 contacts landing ring actuator 202, thereby producing the resultant expansion force in the second stage until the landing ring 116 makes contact with landing groove 114 (See FIG. 3 and FIG. 4). The third stage of expansion is produced by the resultant force from landing ring 116 reacting with landing groove 114 and with lower load ring 204, resulting in landing ring 116 more fully engaging landing groove 114 (FIG. 5).

Various other designs of the landing mechanism are contemplated. For example, in an embodiment of FIG. 2, the lower load ring 204 is a separate and discrete component of the tubing hanger 100. In another embodiment (FIG. 4), lower load ring 204 can be integrally connected with tubing hanger body 214.

Referring again to FIG. 1, and as discussed above, a locking ring 120 for engaging the locking groove 118 and thereby locking tubing hanger 100 into place can be positioned on the tubing hanger 100 above the landing ring 116. The locking ring 120 can have any suitable shape that will function to hold tubing hanger 100 in position within a desired preload. The landing ring 116 described above allows the locking ring 120 to have a deterministic geometry, such as illustrated embodiment of lock ring 116 with cylindrical back, which can be used when the tubing hanger does not necessarily depend on pre-installed equipment for landing support. In an embodiment, the preload can be substantially or entirely determined by the elastic deformation of the locking ring and the components surrounding the locking ring without employing friction dependant mechanisms, such as tapered or threaded components, to preload the tubing hanger.

The locking ring can be made of any suitable material that will provide the desired support, and one of ordinary skill in the art would readily be capable of choosing suitable materials. Examples of suitable materials include metals, such as INCONEL 718, which is commercially available from Alloy Wire International LDT, a company located in the U.K. Other examples of suitable materials are well known in the art.

Referring back to FIG. 1, a locking mechanism 126 can be employed for expanding the locking ring 120 radially outward from the tubing hanger body 214 and locking it into the locking groove 118. Any suitable locking mechanism can be employed. In an embodiment of FIG. 1, locking mechanism 126 includes a sleeve that can be coupled to a control mechanism 128 of tubing hanger running tool 104. Using the control mechanism 128, the locking ring 120 can be actuated to engage the locking groove 118 at any suitable time.

The locking mechanism 126 can be mechanically independent of the landing mechanism 200. For example, the landing mechanism 200 is capable of expanding the landing ring 116 by employing the downward force of the tubing hanger 100 during installation without actuation by the running tool 104. After the landing ring 116 has been expanded into the landing groove 114, the locking mechanism 126 is capable of direct actuation via the controls of running tool 104 to expand the locking ring 120 into the locking groove 118. In an embodiment, the landing mechanism 200 is not capable of direct actuation via the running tool 104 controls to expand the landing ring 116.

A potential benefit of this system is the ability to lock the tubing hanger without significant friction forces on the locking ring 120. This is because the landing ring 116 can support the weight of the tubing hanger, in the manner discussed above, during the engagement of the locking ring 120 with the locking groove 118.

The tubing hangers of the present application can be operated by any suitable method that provides the desired preloading and locking. The method can include expanding a landing ring positioned on the tubing hanger to engage a landing groove. The landing ring can be expanded by any suitable method.

In an embodiment, the method can be carried out using the apparatus in the embodiment of FIG. 1, as described above, wherein expanding the landing ring 116 can comprise running the tubing hanger 100 downward into the wellhead 102 so that a landing mechanism 200 positioned on the tubing hanger 100 is forced against the landing seat 110, the downward force of the landing mechanism 200 against the landing seat 110 causing the landing mechanism 200 to expand the landing ring 116 without further actuation by the running tool. After expanding the landing ring 116 to fix the axial position of tubing hanger 100 in wellhead 102, a locking ring 120 can be expanded to engage the locking groove 118. In an embodiment, the locking ring 120 can be positioned on the tubing hanger 100 above the landing ring 116. In alternative embodiments, the locking ring can be placed in any other suitable position, including in positions below the landing ring 116.

In the above described embodiments, the landing ring and locking ring are illustrated as comprising a single integral component. However, in an alternative embodiment, both a landing ring and a locking ring can be replaced by segmented components with similar cross sections.

In an alternative embodiment, both a landing ring and a locking ring can be expanded using, for example, running tool or some other apparatus that can control the expansion of the landing and locking rings. Thus, the landing and locking rings can be actuated by any suitable methods that allow the tubing hanger to be accurately positioned in the wellhead prior to locking, so that locking of the tubing hanger can provide the desired preloading. Given the teachings of the present application, one of ordinary skill in the art would readily be able to make and use tubing hangers for implementing such methods.

Although various embodiments have been shown and described, the present disclosure is not so limited and will be understood to include all such modifications and variations as would be apparent to one skilled in the art.

What is claimed is:

1. A tubing hanger for use in a wellhead, the wellhead including a throughbore, a landing seat positioned in the throughbore, a landing groove positioned above the landing seat in the throughbore, and a locking groove in the throughbore, the tubing hanger comprising:

an expandable landing ring positioned on the tubing hanger for engaging the landing groove;

a landing mechanism for expanding the landing ring radially outward from the tubing hanger;

a locking ring for engaging the locking groove, the locking ring being positioned on the tubing hanger;

a locking mechanism for expanding the locking ring radially outward from the tubing hanger body and locking it into the locking groove; and wherein the landing mechanism is positioned to engage the landing seat during installation of the tubing hanger into the wellhead, the landing mechanism being configured so that a downward force of the landing mechanism on the landing seat during the installation is capable of expanding the landing ring into the landing groove.

2. The tubing hanger of claim 1, wherein the landing mechanism comprises a landing ring actuator positioned between the expandable landing ring and the landing seat, the landing ring actuator being configured to engage the landing seat in a manner that provides radial expansion of the landing ring by a first distance.

3. The tubing hanger of claim 2, wherein the landing mechanism further comprises a lower load ring positioned above the expandable landing ring, the lower load ring being configured to engage the landing ring and provide additional radial expansion of the landing ring by a second distance so that the landing ring fully engages the landing groove.

4. The tubing hanger of claim 1, wherein the landing ring and the locking ring comprise segmented components.

5. The tubing hanger of claim 1, wherein the locking ring engaged in the locking groove provides a desired preload to the tubing hanger.

6. The tubing hanger of claim 5, wherein the preload is determined by the elastic deformation of the locking ring and the components surrounding the locking ring without employing an additional friction dependent preloading mechanism chosen from a tapered feature and a threaded feature.

7. The tubing hanger of claim 1, wherein the landing groove is positioned a first distance from the landing seat and the locking groove is positioned a second distance from the landing seat, the second distance being greater than the first distance.

8. A method for locking a tubing hanger in a wellhead, the wellhead including a throughbore, a landing seat positioned in the throughbore, a landing groove positioned above the landing seat in the throughbore, and a locking groove positioned in the throughbore, the method comprising:

expanding a landing ring positioned on the tubing hanger to engage the landing groove; and expanding a locking ring to engage the locking groove, the locking ring being positioned on the tubing hanger, wherein the locking ring is expanded after the expanding of the landing ring, wherein expanding the landing ring comprises running the tubing hanger downward into the wellhead using a running tool so that a landing mechanism positioned on the tubing hanger reacts against the landing seat, the downward force of the landing mechanism against the landing seat causing the landing mechanism to expand the landing ring.

9. The method of claim 8, wherein other than by running the tubing hanger into the wellhead, the landing mechanism is not directly actuated via the running tool controls to expand the landing ring.

10. The method of claim 9, wherein the locking mechanism is actuated via the running tool controls to expand the locking ring after the landing ring has been expanded into the landing groove.

11. The method of claim 8, wherein expanding the locking ring to engage the locking groove provides a preload to the tubing hanger.

12. The method of claim 8, wherein the preload is determined by the elastic deformation of the locking ring and the components surrounding the locking ring without employing an additional friction dependent preloading mechanism chosen from at least one of a tapered feature and a threaded feature.

13. A tubing hanger for use in a wellhead, the wellhead including a throughbore, a landing seat positioned in the throughbore, a landing groove positioned above the landing seat in the throughbore, and a locking groove in the throughbore, the tubing hanger comprising:

an expandable landing ring positioned on the tubing hanger for engaging the landing groove;

a landing mechanism for expanding the landing ring radially outward from the tubing hanger;

a locking ring for engaging the locking groove, the locking ring being positioned on the tubing hanger; and a locking mechanism for expanding the locking ring radially outward from the tubing hanger body and locking it into the locking groove, wherein the tubing hanger is capable of engaging a running tool, and further wherein the landing mechanism is capable of expanding the landing ring by employing the downward force of the tubing hanger during installation without actuation by the running tool.

14. The tubing hanger of claim 13, wherein the locking mechanism is capable of actuation to expand the locking ring after the landing ring has been expanded into the landing groove.

15. The tubing hanger of claim 14, wherein the running tool actuates the locking ring.

* * * * *